US006530386B1

(12) United States Patent
Bragulla et al.

(10) Patent No.: US 6,530,386 B1
(45) Date of Patent: Mar. 11, 2003

(54) METHOD OF CLEANING RETURNABLE BOTTLES

(75) Inventors: Siegfried Bragulla, Monheim (DE); Brian Glanville, Kent (GB); Andreas Potthoff, Dusseldorf (DE); Harald Kluschanzoff, Mettmann (DE); Alfred Laufenberg, Dormagen (DE)

(73) Assignee: Henkel Ecolab GmbH & Co. OHG, Dusseldorf (DE)

( * ) Notice: Subject to any disclaimer, the term of this patent is extended or adjusted under 35 U.S.C. 154(b) by 0 days.

(21) Appl. No.: 09/890,612

(22) PCT Filed: Jan. 25, 2000

(86) PCT No.: PCT/EP00/00532

§ 371 (c)(1),
(2), (4) Date: Oct. 2, 2001

(87) PCT Pub. No.: WO00/45969

PCT Pub. Date: Aug. 10, 2000

(30) Foreign Application Priority Data

Feb. 4, 1999 (DE) ..... 199 04 512

(51) Int. Cl.[7] ..... B08B 9/42

(52) U.S. Cl. ..... 134/25.4; 134/15; 134/22.1; 134/22.18; 134/22.19; 134/23; 134/26; 134/32; 134/34; 134/36; 134/42; 435/264; 510/219; 510/226; 510/392

(58) Field of Search ..... 134/15, 22.1, 22.18, 134/22.19, 23, 25.4, 26, 32, 36, 34, 42; 435/264; 510/219, 226, 392

(56) References Cited

U.S. PATENT DOCUMENTS

| | | | | | |
|---|---|---|---|---|---|
| 5,719,112 | A | * | 2/1998 | Gordon et al. | 510/221 |
| 5,858,117 | A | * | 1/1999 | Oakes et al. | 134/26 |
| 5,861,366 | A | * | 1/1999 | Ihns et al. | 510/234 |
| 6,191,092 | B1 | * | 2/2001 | Bragulla et al. | 510/226 |
| 6,326,346 | B1 | * | 12/2001 | Brenchley et al. | 134/40 |

FOREIGN PATENT DOCUMENTS

| | | | | |
|---|---|---|---|---|
| DE | 2 259 201 | A | | 6/1974 |
| DE | 32 05 956 | A1 | | 9/1983 |
| DE | 40 14 747 | A1 | | 11/1991 |
| DE | 44 11 223 | A1 | | 10/1995 |
| DE | WO9814547 | A1 | * | 4/1998 |
| DE | WO9847993 | | * | 10/1998 |
| DE | WO9905252 | A1 | * | 2/1999 |
| DE | 19838939 | A1 | * | 3/2000 |
| EP | 0 110 472 | | | 6/1984 |

OTHER PUBLICATIONS

Siezen et al. "Homology modeling and protein engineering strategy of subtilases, the family of subtilisin–like serine proteinases". Protein Engineering vol. 4, No. 7, pp. 719–737, 1991.

* cited by examiner

*Primary Examiner*—Sharidan Carrillo
(74) *Attorney, Agent, or Firm*—Merchant & Gould P.C.

(57) ABSTRACT

A method for cleaning returnable bottles and similar containers used in the food industry. The method uses an enzymatic solution during the cleaning process. The cleaning results are at least as good as conventional methods, without requiring an increase in the duration of cleaning. The method substantially reduces bottle corrosion and waste water pollution compared to conventional methods.

11 Claims, No Drawings

METHOD OF CLEANING RETURNABLE BOTTLES

BACKGROUND OF THE INVENTION

This invention relates generally to institutional cleaning and more particularly to an automatic "mild" process for cleaning returnable bottles and other reusable containers designed to hold foods.

Many foods, more particularly dairy products and beverages, are being increasingly sold in reusable packs which, after emptying, are returned by the customer and may be reused as a pack for the same foods. Examples of foods thus packaged are milk, cocoa, cream, yoghurt, mixed milk drinks, mineral waters, fruit juices, beer, lemonade, soft drinks and other mixed beverages. The returnable containers may consist of various materials, more particularly glass or plastics, such as polycarbonate (PC), polyvinyl chloride (PVC), polyesters (for example polyethylene terephthalate, PET, or polyethylene naphthenate, PEN) and polyethylene (PE). The containers may be adapted in shape to a variety of applications. Thus, bottles are preferably used for liquids while cups or cans are preferably used for foods with a pasty, gel-like or solid consistency. In the interests of simplicity, the present specification refers solely to bottles or the cleaning of bottles in the following although other containers to be cleaned in this way and their cleaning are of course also meant to be included.

It is obvious that the used bottles returned by the consumer have to be cleaned in a hygienically satisfactory manner before they are re-used. In the institutional sector, this is normally done using fully automatic cleaning machines in which the bottles are conveyed through several cleaning zones. These cleaning machines differ in construction according to the nature of the containers and the foods used. In general, the machines comprise at least one prerinse zone. In at least one other following zone, the containers are treated with a cleaning solution at elevated temperature. Finally, there is at least one other zone in which the bottles are rinsed with water. The prerinse zone is also often referred to as the presoak zone and the zone in which the containers are treated with the cleaning solution as the "liquor" zone. Several separate zones may be present both for the prerinse phase, the cleaning phase and the final rinse phase. Depending on the particular application, other zones, for example a preliminary bottle emptying zone, may be provided. The contacting of the bottles with the cleaning liquids can take place differently in each zone, generally by spraying or immersion. As they pass through the machine, the bottles are normally first heated slowly in the precleaning zone, are then treated at a much higher temperature in the liquor zone and, thereafter, are cooled again in the following rinse zones. By virtue of this division into different baths and zones, detergents, water and heat are economically and effectively used.

After loosely adhering food residues and soils have been removed in the prerinse zone, the bottles are actually cleaned in the liquor zone. This zone comprises at least one station where the bottles are cleaned with a cleaning solution at high temperatures of normally about 60 to 90° C., depending on the bottle material. Particularly good cleaning effects are obtained where one to three liquor baths are combined with a following liquor spray zone. Conventional cleaning processes use as liquor a cleaning solution which contains ca. 1 to 3% of sodium hydroxide and additions of sequestering agents, surfactants and other detersive components.

Hitherto, the belief was that satisfactory cleaning of the bottles in a short time could only be achieved with liquors as highly alkaline as this notwithstanding the disadvantages of using such cleaning solutions. Thus, the use of strongly alkaline liquors placed a heavy burden on wastewater treatment plants which was further increased by the presence in these strongly alkaline liquors of certain non-readily biodegradable auxiliary chemicals. In addition, the surfaces of glass bottles and various plastic bottles were attacked under the extreme conditions so that the bottles soon assumed an unattractive appearance and, in many cases, even had to be removed from the circuit at an early stage. The saponification of fat-containing residues often resulted in problems with foam. Defoamers had to be added as a countermeasure. Their critical wash-out behavior gave them the potential to contaminate the food to be packaged. Finally, the use of strongly alkaline cleaning liquors exposed the machine operator to a significant risk, of "burning".

BRIEF SUMMARY OF THE INVENTION

Starting out from these observations, the problem addressed by the present invention was to provide an improved process for cleaning bottles which would avoid the disadvantages of conventional processes without any deterioration in the cleaning result.

It has surprisingly been found that this problem can be solved by the use of an enzyme-containing cleaning solution in the cleaning zone.

DETAILED DESCRIPTION OF THE INVENTION

Accordingly, the present invention relates to a process for cleaning returnable bottles and similar containers designed to hold foods, in which the used bottles are conveyed through several zones in a bottle washing machine of which at least one zone is intended for prerinsing, at least one following zone for treatment with a cleaning solution at elevated temperature and at least one other zone for rinsing with water, at least one enzyme being added to the cleaning solution to boost its cleaning performance. Enzymes from the group of proteases, amylases, cellulases, lipases, oxidoreductases and mixtures of these enzymes are preferably used. The use of proteases, especially highly alkaline proteases, on their own or together with other enzymes is particularly preferred.

The present invention also relates to the use of a corresponding solution in the process described above.

Surprisingly, it is possible by the new process to achieve an at least equivalent result in the same short times as with conventional highly alkaline cleaning liquors, but at distinctly lower temperatures and distinctly lower pH values. In many cases, a far better cleaning result is achieved than with conventional highly alkaline cleaning liquors despite a lower concentration of active substance in the cleaning liquor. The possibility of using lower concentrations of detersive chemicals and biodegradable active substances makes the new process particularly environmentally friendly. The corrosion of the bottle surfaces is negligible and, in addition, energy is saved through the low working temperatures.

According to the invention, suitable enzymes are any enzymes which have a degrading effect on the food remains and soils to be removed. The above-mentioned enzymes from the group of proteases, arnylases, cellulases, glycosidases, lipases and oxidoreductases are particularly preferred. Through the choice of various enzymes, the cleaning process can be specifically adapted to the particular food residues to be removed. Thus, proteases are preferably used for removing protein-containing soils while amylases are preferably used for starch-containing soils and lipases for removing fatty soils. The combination of several enzymes for different substrates is recommended in cases where mixed soils are present. Accordingly, proteases are mainly used for the preferred application of the process according to the invention for cleaning bottles used for dairy products, more especially milk bottles. The use of so-called highly alkaline proteases which have an isoelectric point above pH 10 and optimal activity at a pH of about 9 to about 12 is particularly preferred. The most important representatives of this group of enzymes include certain representatives of the serine proteases known as subtilisins which are obtained from bacteria and which, as a sub-group, have acquired the common name of I-S2 in the scientific literature. This group includes, for example, the enzymes known as subtilisin 147, subtilisin 309 and subtilisin PB92 (see also R. J. Siezen et al, Protein Engineering, Vol. 4, No. 7, 719–737 (1991)). Highly alkaline proteases are also commercially available as enzyme preparations, for example under the names of SAVINASE®, ESPERASE®, DURAZYM®, MAXACAL®, PLURAFECT®, OPTICLEAN® and BLAP®. Besides the actual active enzyme, these preparations generally contain relatively large amounts of stabilizers and carriers.

The enzyme content is normally not expressed in percent by weight, but instead in standardized manner as activity units, i.e. for the proteases the available protein-splitting activity in the particular enzyme preparation or in the enzyme-containing solution. In the following, the unit KNPU (Kilo Novo Protease Units) introduced by the Novo Company is used for proteases; other units may require a corresponding conversion. In the case of proteases, the enzyme solution used in accordance with the invention should preferably contain about 0.16 KNPU to about 160 KNPU and more particularly about 0.8 KNPU to about 80 KNPU per liter. The range from about 1.6 KNPU to about 16 KNPU per liter of cleaning solution is particularly preferred. The content of the other enzymes is similarly measured in the following units:

unit for amylase: MWU (Modified Wohlgemut Unit)

unit for lipase: KLU (Kilo Lipase Unit). 0.2 to 100 units of these enzymes are preferably used per liter of cleaning solution. Basically, however, the necessary quantity of enzyme is always determined by the particular cleaning problem to be solved so that quantities larger or smaller than those mentioned above may readily be used in individual cases.

The cleaning solution used in accordance with the invention is preferably prepared from the highly concentrated liquid or powder-form enzyme preparations offered by various manufacturers. The blending agents, auxiliaries and solvents added to these enzyme preparations then also become part of the cleaning solution. The preparations of highly alkaline proteases commercially available under the names of SAVINASE®, MAXACAL® and BLAP® are particularly preferred for the process according to the invention.

The final enzyme-containing cleaning solutions intended to act on the bottles generally have a weakly alkaline pH which is preferably between about 8 and about 12 and more particularly between about 8.5 and about 9.5 (as measured at 20° C.). A pH well below the value at the maximum activity of the enzyme is selected above all when the activity of the enzyme in the cleaning solution is to be maintained for prolonged periods. The pH can be adjusted in known manner, for example by using buffering agents or even by a device for automatically dispensing the necessary quantity of alkali.

In the process according to the invention, the cleaning solution is intended to act on the bottles at elevated temperature, temperatures well below those used in the hitherto known cleaning of bottles with highly alkaline solutions being sufficient. The contact temperatures are preferably between about 30 and about 70° C. and more particularly between about 40 and about 55° C. Despite these low contact temperatures, the contact times required to obtain a satisfactory cleaning result are no longer than in conventional cleaning processes.

Besides the constituents already mentioned, the enzyme-containing cleaning solutions used in accordance with the invention may contain other active substances and auxiliaries. Surfactants for boosting the cleaning effect are mentioned above all in this regard. Basically, surfactants from any known classes may be used. However, nonionic, cationic and amphoteric surfactants are preferred, the nonionic surfactants having the greatest importance. Examples of other auxiliaries and additives are enzyme stabilizers, such as soluble calcium salts and borates, compounds with a threshold effect, complexing agents, builders, thickeners, antioxidants, foam inhibitors and preservatives. In selecting these auxiliaries/additives, it is important to ensure that they do not interact undesirably with one another or with the enzymes.

Suitable nonionic surfactants are in particular the addition products of long-chain alcohols, alkyl phenols, amides and carboxylic acids with ethylene oxide (EO) and optionally together with propylene oxide (PO). These include, for example, the addition products of long-chain primary and secondary alcohols containing 12 to 18 carbon atoms in the chain, more particularly fatty alcohols and oxo alcohols of this chain length, with 1 to 20 moles EO and the addition products of fatty acids containing 12 to 18 carbon atoms in tie chain with preferably 2 to 8 moles ethylene oxide. The mixed addition products of ethylene and propylene oxide and $C_{12-18}$ fatty alcohols, more especially those containing about 2 moles EO and about 4 moles PO in the molecule, are particularly preferred. Depending on the embodiment, the open terminal functional alcohol group may also be end-capped by an alkyl group. The alkyl group is preferably a methyl or butyl group. Examples of suitable nonionic surfactants are the fatty alcohol alkoxylates marketed by Henkel KGaA under the names of DEHYPON® LS24, DEHYPON® LS54, EUMULGIN® 05, DEHYDOL® LT8, DEHYDOL® LT6, DEHYDOL® LS6 and DEHYDOL® LT104. Other suitable nonionic surfactants are the esters of $C_{6-12}$ fatty acids and polyols, more particularly carbohydrates, for example glucose. Where nonionic surfactants are present in the cleaning solutions used in accordance with the invention, their content therein is preferably about 0.001 to about 0.08% by weight and more particularly about 0.01 to about 0.05% by weight, based on the ready-to-use cleaning solution.

Suitable cationic surfactants are, in particular, aliphatic and heterocyclic quaternary ammonium compounds and quaternary phosphonium compounds which contain at least one long-chain $C_{8-18}$ alkyl group at the quaternary center. Examples of such cationic surfactants are cocoalkyl benzyl dimethyl ammonium chloride, dioctyl dimethyl ammonium chloride and tributyl tetradecyl phosphonium chloride.

Suitable amphoteric surfactants are, in particular, $C_{8-18}$ fatty aid amide derivatives of betaine structure, more particularly derivatives of glycine, for example cocoalkyl dimethyl ammonium betaine. Cationic and amphoteric surfactants are used in the cleaning solution in quantities of preferably not more than 0.08% and more particularly between 0.001 and 0.02% by weight.

Suitable threshold-effect compounds are polyphosphates, phosphonic acids and polycarboxylates. Suitable polyphosphates are, in particular, orthophosphate, pyrophosphate, tripolyphosphate, tetrapolyphosphate, hexametaphosphate. Suitable phosphonic acids are, above all, nitrilotrimethylene phosphonic acid, hydroxyethane diphosphonic acid, phosphonobutane tricarboxylic acid and other derivatives of phosphonic acid. Suitable polycarboxylates preferably come from the class of polyacrylates, polysuccinates, polyaspartates or other salts of polyorganic acids. Suitable builders are the already mentioned polyphosphates, phosphatonates, gluconates, citrates, EDTA, NTA and other complexing agents suitable as builders. Threshold-effect compounds are used in quantities of preferably about 0.002 to about 0.05% by weight and more particularly about 0.004 to about 0.02% by weight, based on the final cleaning solution.

To prepare the cleaning solution used in accordance with the invention, the individual constituents may in principle be separately added to and dissolved in the water. However, it is more appropriate to start with concentrates prepared in advance which contain several or preferably all of the constituents in the correct mixing ratio so that only a few "dosing" steps or only one are/is necessary. Liquid concentrates are particularly easy to dose although concentrated formulations in the form of powders, tablets or pastes are also suitable. Additional constituents of liquid concentrates include solubilizers, such as cumene sulfonate, xylene sulfonate and octyl sulfonate although other typical solubilizers may of course also be used. The solubilizer content is selected as required and is preferably about 1 to about 10% by weight and more particularly about 2 to about 5% by weight, based on the concentrate as a whole. Liquid concentrates may additionally contain relatively large quantities of organic solvents, especially polyols, for example propylene glycol or glycerol. General formulations for a liquid concentrate and a solid concentrate are given below:

Liquid Cleaning Concentrate:

| | |
|---|---|
| enzyme, especially protease | 1 to 10, preferably 3 to 6% by weight |
| propylene glycol | 5 to 80, preferably 20 to 40% by weight |
| glycerol | 5 to 20, preferably 5 to 8% by weight |
| nonionic surfactant | 2 to 40, preferably 5 to 25% by weight |
| enzyme stabilizer | 1 to 10, preferably 2 to 5% by weight |
| quaternary ammonium compound, for example dioctyl dimethyl ammonium chloride | 1 to 40, preferably 2 to 5% by weight |
| balance to 100% by weight water | |

Solid Cleaning Concentrate:

| | |
|---|---|
| enzyme, especially protease | 1 to 10, preferably 3 to 6% by weight |
| sodium and/or potassium carbonate | 5 to 50, preferably 10 to 30% by weight |
| sodium and/or potassium bicarbonate | 5 to 50, preferably 10 to 30% by weight |
| nonionic surfactant | 2 to 40, preferably 5 to 25% by weight |
| quaternary ammonium compound, for example dioctyl dimethyl ammonium chloride | 1 to 40, preferably 2 to 10% by weight |
| sodium and/or potassium triphosphate | 1 to 30, preferably 3 to 10% by weight |
| phosphonate | 0.5 to 5, preferably 1 to 3% by weight |

The concentrates are normally added to the water in quantities of about 0.05 to about 0.5% by weight and preferably in quantities of 0.1 to 0.2% by weight to obtain a cleaning solution ready to use for the process according to the invention.

EXAMPLES

The cleaning test was carried out in a one-ended bottle washing machine of the type often encountered in practice and marketed by such manufacturers as Krones, KHS or Simonazzi. The treatment sequence in the machine comprised two presoak stages, a liquor soaking zone, two liquor spray zones, an "after-liquor" zone, two warm water baths with spray nozzles for rinsing out the cleaning solution and a cold water zone with fresh water spray nozzles.

The object of the cleaning test was to clean heavily soiled glass milk bottles returned by consumers to the milk bottling plant as normal returns within the liquor treatment time (liquor soak, liquor spray and after-liquor) of ca. 8 minutes.

First, the test was carried out with 50,000 dirty bottles in a conventional cleaning liquor. This liquor contained an aqueous solution of ca. 2% NaOH, 0.02% sodium gluconate, 0.02% sodium citrate, 0.04% DEHYPON® LT 104, 0.02% NTA. The total contact title including immersion and spraying was ca. 8 minutes while the contact temperature was about 85° C. Visual inspection showed 258 of the 50,000 bottles to be not entirely clean.

After this test, the entire cleaning solution was drained off and a fresh solution prepared. The new cleaning solution contained an aqueous solution of ca. 0.005% ESPERASE®, 0.036% butyl glycol, 0.020% DEHYPON®LT 104. The total contact time was again ca. 8 minutes while the contact temperature was about 50° C. Of 50,000 dirty bottles, only 26 were visually identified as having residues after the cleaning test.

What is claimed is:

1. A process for cleaning returnable bottles or containers designed to hold foods, the process comprising the steps of:

a. conveying the bottles or containers through several zones in a bottle washing machine, the several zones comprising a zone for pre-rinsing, a treatment zone following the pre-rinsing zone for treatment with an aqueous cleaning solution at a pH of about 8 to about 12 and a temperature of about 30° to about 70° C. and a zone following the treatment zone for rinsing with water; and b. washing the bottles or containers in the treatment zone with said aqueous cleaning solution comprising:

i. at least one enzyme chosen from the group consisting of proteases, amylases, cellulases, lipases, and oxidoreductases:

ii. at least one polyol; and iii. at least one non-ionic surfactant comprising an addition product of a 12–18 carbon alcohol and ethylene oxide or propylene oxide wherein the addition product is end-capped by an alkyl group.

2. A process as in claim 1, wherein the bottles or containers are treated with the aqueous cleaning solution at temperatures of 40° C. to 55° C.

3. A process as in claim 1, wherein the aqueous cleaning solution comprises at least one protease.

4. A process as in claim 1, wherein the aqueous cleaning solution has a pH of about 8.5 to about 9.5.

5. A process as in claim 1, wherein the aqueous cleaning solution comprises at least one additive selected from the group consisting of surfactants, buffering agents, enzyme stabilizers, polyphosphates, phosphonic acids, polycarboxylates, complexing, agents, builders, thickeners, antioxidants, foam inhibitors and preservatives.

6. A process as in claim 1, wherein the aqueous cleaning solution is prepared from a concentrate by diluting the concentrate with water.

7. A process as in claim 3, wherein the protease is an alkaline protease having optimal activity at a pH of about 9 to about 12.

8. A process as in claim 3, wherein the aqueous cleaning cleaning solution comprises 0.16 to 160 KNPU of protease per liter.

9. A process as in claim 7, wherein the protease is a subtilisn.

10. A process as in claim 8, wherein the aqueous cleaning solution comprises 0.8 to 80 KNPU of protease per liter.

11. A process as in claim 8, wherein the aqueous cleaning solution comprises 1.6 to 16 KNPU per liter.

* * * * *